US006487957B2

(12) United States Patent
Colimitra

(10) Patent No.: US 6,487,957 B2
(45) Date of Patent: Dec. 3, 2002

(54) FLUID-OPERATED CYLINDER PROVIDING LINEAR AND ROTARY MOTION

(76) Inventor: Thomas A. Colimitra, 22 Lynn Dr., Monroe, CT (US) 06468

( * ) Notice: Subject to any disclaimer, the term of this patent is extended or adjusted under 35 U.S.C. 154(b) by 29 days.

(21) Appl. No.: 09/822,147

(22) Filed: Apr. 2, 2001

(65) Prior Publication Data

US 2002/0139243 A1 Oct. 3, 2002

(51) Int. Cl.[7] ..... F01B 13/00

(52) U.S. Cl. ..... 92/54

(58) Field of Search ..... 92/54; 173/148

(56) References Cited

U.S. PATENT DOCUMENTS 3,407,680 A * 10/1968 Westmoreland ..... 310/112
3,918,533 A * 11/1975 Weber ..... 173/155
6,362,547 B1 * 3/2002 Peterson et al. ..... 310/12

* cited by examiner

*Primary Examiner*—Edward K. Look
*Assistant Examiner*—Thomas E. Lazo
(74) *Attorney, Agent, or Firm*—John H. Crozier

(57) ABSTRACT

In a preferred embodiment, a fluid-operated cylinder to provide both linear and rotary motion to tooling, including: a cylindrical, rotatable member for attachment to rotatable means; a circular piston disposed in the cylindrical, rotatable member for back and forth axial motion in a cavity defined therein and rotatable by rotation of the cylindrical, rotatable member; a first port defined through the cylindrical rotatable member to introduce pressurized fluid into the cavity on a first side of the circular piston such as to cause the circular piston to move in a first direction; and a piston shaft fixedly attached to the circular piston and fixedly attachable to the tooling; whereby: when the rotatable member is rotated, rotary motion will be transmitted to the tooling by the piston shaft, and when the pressurized fluid is introduced into the cavity on the first side of the circular piston, the piston shaft will cause the tooling to move in the first direction.

3 Claims, 3 Drawing Sheets

FLUID-OPERATED CYLINDER PROVIDING LINEAR AND ROTARY MOTION

BACKGROUND OF THE INVENTION

1. Field of the Invention

The present invention relates to fluid-operated cylinders generally and, more particularly, but not by way of limitation, to a novel fluid-operated cylinder that provides both linear and rotary motion.

2. Background Art

A number of well-known operations require the provision of both rotary and linear motion. For example, the simple robotic placing of a screw in a threaded hole requires that linear motion be provided such that the screw can be advanced toward the hole and, when the end of the screw reaches the hole, the linear motion continues, while rotary motion is required to thread the screw into the hole. Many other such uses of both linear and rotary motion can be cited wherein the linear and rotary motion is sequential or consecutive or some combination thereof Electromechanical devices that provide both linear and rotary motion are well known. An example of such a device is described in U.S. Pat. No. 3,407,680, issued Oct. 29, 1968, to Westmoreland, and titled RECIPROCATING POWER ARRANGEMENTS. Described therein is an electromagnetic linear/rotary device comprising two electric motors having a common shaft extending therethrough. One motor cooperates with a splined portion of the shaft such that rotary motion of the motor causes the shaft to rotate. The other motor cooperates with a threaded portion of the shaft such that rotary motion of the motor causes the shaft to advance axially one direction or the other depending on the direction of rotation of the motor. Linear, rotary, or both linear and rotary motion of the shaft is provided depending on whether both motors are operating and the speed at which one or both of the motors is operated. One or both ends of the shaft may be operatively attached to other elements.

Electromechanical devices have certain drawbacks, among which are the relatively complex control devices required and, if the electromechanical devices are used in a hazardous environment, special equipment must be employed to avoid explosions, etc.

Also well known are fluid-operated cylinders that typically employ a stationary cylinder having disposed therein a piston. Pressurized fluid, air or hydraulic oil, for example, is introduced into the cylinder on one side of the piston to drive the piston and a shaft attached thereto linearly in one direction. A workpiece, biasing means, and/or the introduction of pressurized fluid into the cylinder on the other side of the piston drives the piston and a shaft attached thereto in the other direction. Such an arrangement is simple, is easily controlled, and is relatively safe in hazardous environments. However, such a cylinder is deficient in that it does not provide rotary motion as well as linear motion.

Accordingly, it is a principal object of the present invention to provide a fluid-operated cylinder that provides both linear and rotary motion.

It is a further object of the invention to provide such a cylinder that lends itself well to robotic operations.

It is an additional object of the invention to provide such a cylinder that can be economically constructed using conventional techniques.

It is another object of the invention to provide such a cylinder that is single-acting.

It is yet a further object of the invention to provide such a cylinder that is double-acting.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a fluid-operated cylinder to provide both linear and rotary motion to tooling, comprising: a cylindrical, rotatable member for attachment to rotatable means; a circular piston disposed in said cylindrical, rotatable member for back and forth axial motion in a cavity defined therein and rotatable by rotation of said cylindrical, rotatable member; a first port defined through said cylindrical rotatable member to introduce pressurized fluid into said cavity on a first side of said circular piston such as to cause said circular piston to move in a first direction; and a piston shaft fixedly attached to said circular piston and fixedly attachable to said tooling; whereby: when said rotatable member is rotated, rotary motion will be transmitted to said tooling by said piston shaft, and when said pressurized fluid is introduced into said cavity on said first side of said circular piston, said piston shaft will cause said tooling to move in said first direction.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which.

DETAILED DESCRIPTION OF THE PREFERRED EMBODIMENTS

Figure 1:
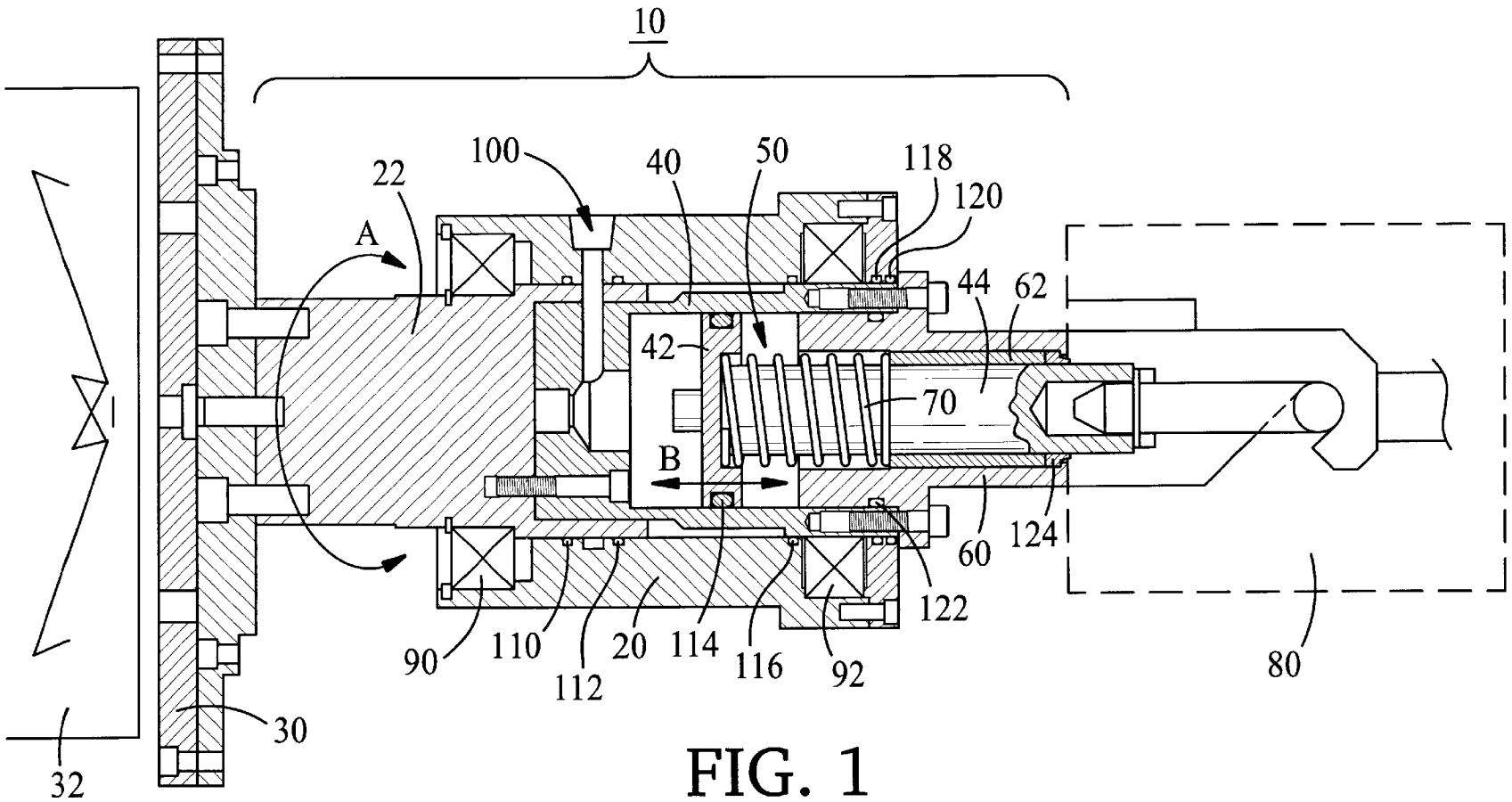
FIG. 1 is a side elevational view, partially in cross-section, of a single-acting fluid-operated cylinder providing both linear and rotary motion, according to one embodiment of the present invention.

Reference should now be made to the drawing figures on which similar or identical elements are given consistent identifying numerals throughout the various figures thereof, and on which parenthetical references to figure numbers direct the reader to the view(s) on which the element(s) being described is (are) best seen, although the element(s) may be seen on other figures also.

FIG. 1 illustrates a fluid-operated cylinder providing both linear and rotary motion, according to one embodiment of the present invention, and generally indicated by the reference numeral 10. Cylinder 10 includes a cylindrical, stationary outer shell 20 having partially disposed therein a cylindrical rotary shaft 22. Rotary shaft 22 can be given rotary motion in either direction, as indicated by the double-headed arrow "A", by means of fixed attachment to a rotatable adapter plate 30 extending from housing 32 of what may be assumed to be a robotic device (not otherwise shown). A rotatable, cylindrical, inner shell 40 is fixedly attached to rotary shaft 22 and has disposed therein a circular piston 42, with a piston shaft 44 fixedly attached thereto, for axial motion back and forth motion within the inner shell, as indicated by the double-headed arrow "B". Inner shell 40 defines a cavity 50 in which piston 42 is disposed.

An inner shell extension 60 is fixedly attached to the distal end of inner shell 40 and has fixedly disposed therein a cylindrical sleeve insert 62 in which piston shaft 44 is journaled. A compression spring 70 is disposed between the proximal end of sleeve insert 62 and the right side of piston 42 to urge the piston to the left on FIG. 1. The distal end of piston shaft 44 is attached to tooling 80, the form of the tooling shown being for illustrative purposes only and forming no part of the present invention. It will be understood, however, that tooling 80 is to be given both linear and rotary motion either sequentially or consecutively.

A first circular bearing structure 90 is disposed between outer shell 20 and rotary shaft 22 and a second circular bearing structure 92 is disposed between the outer shell and inner shell 40 to provide suitable support for the relative rotational motion of those members. A port 100 defined in outer shell 20 is provided for communication with a source (not shown) of pressurized fluid, such as air or hydraulic oil, and cavity 50 on the left side of piston 42 on FIG. 1. Circular seals 110, 112, 114, 116, 118, 120, 122, and 124 are provided as shown to seal between the various components of cylinder 10, the seals being of suitable conventional materials for the pressurized fluid employed. Outer shell 20 may be rendered stationary by means of fixed attachment to housing 32 or to other structure immobile with respect to the housing (means of attachment not shown on FIG. 1).

In use, pressurized fluid is introduced through port 100 into cavity 50 on the left side of piston 42 on FIG. 1, thus driving the piston, piston shaft 44, and tooling 80 to the right on FIG. 1 When pressure is released, compression spring 70 causes those elements to be driven to the left on FIG. 1. Concomitantly with, or before and/or after, those elements may be given rotary motion by means of rotation of adapter plate 30. That motion, in turn causes rotary shaft 22, inner shell 40, piston 42, piston shaft 44, inner shell extension 60, and sleeve insert 62 to rotate, thus causing tooling 80 to rotate. Speed and direction of rotation of tooling 80 will depend, of course, on the speed and direction of rotation of adapter plate 30.

Figure 2:
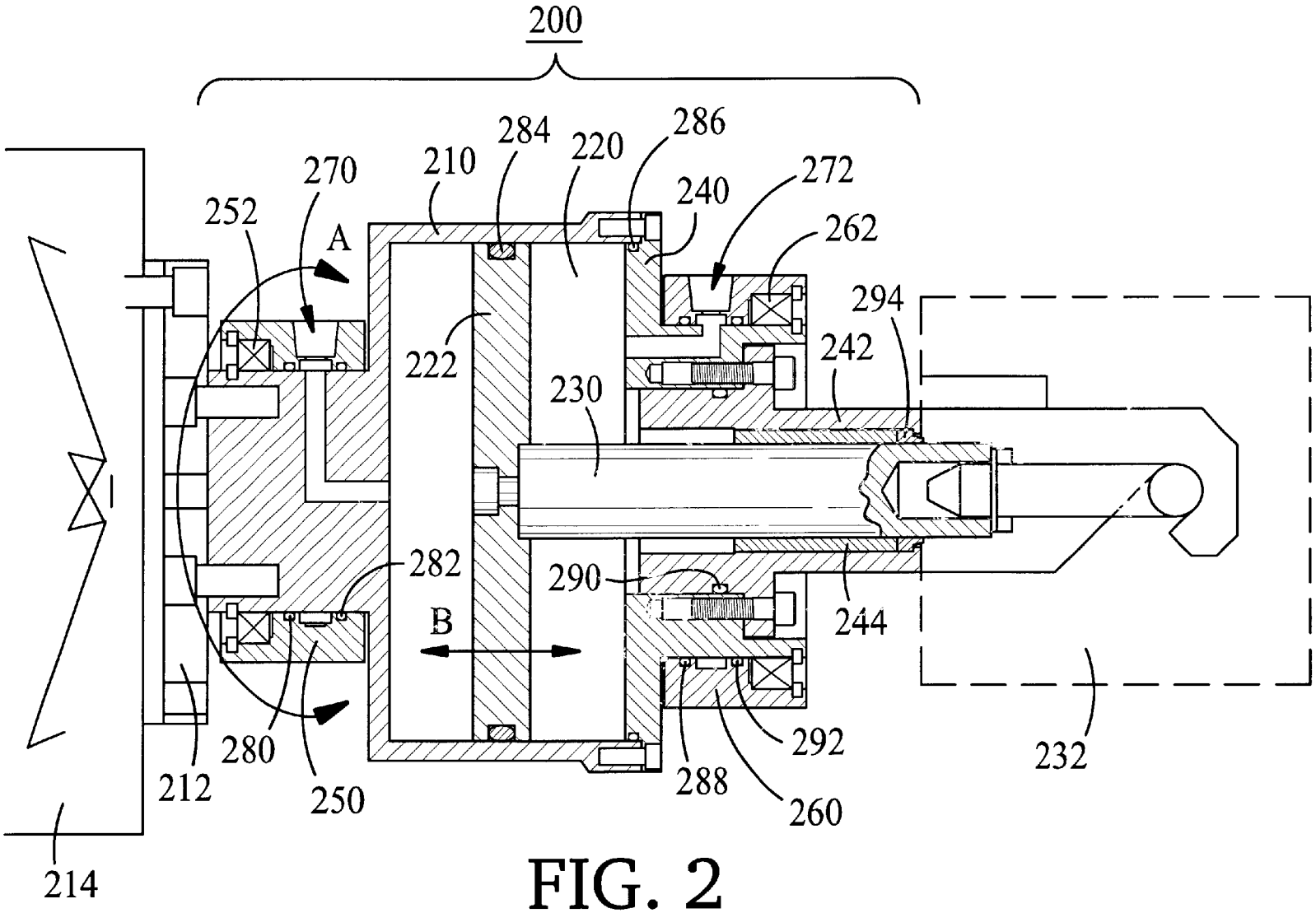
FIG. 2 is a side elevational view, partially in cross-section, of a double acting fluid-operated cylinder providing both linear and rotary motion, according to another embodiment of the present invention.

FIG. 2 illustrates a fluid-operated cylinder that provides both linear and rotary motion, constructed according to another embodiment of the present invention, and generally indicated by the reference numeral 200. Cylinder 200 includes a cylindrical rotary shell 210 fixedly attached to an adapter plate 212 associated with a housing 214, for rotary motion, as indicated by the double-headed arrow "A". Rotary shell 210 defines therein a cavity 220 in which rotary shell and cavity is disposed a circular piston 222 for back and forth axial motion therein, as indicated by the double-headed arrow "B". Attached to piston 222 at the right side thereof on FIG. 2 is the proximal end of a piston shaft 230 having its distal end attached to tooling 232.

A circular rotary shell end cover 240 is fixedly attached to the distal end of rotary shell 210 and a cylindrical cover extension 242 having a cylindrical sleeve insert 244 fixedly disposed therein is fixedly attached to the shell cover. A first stationary bearing housing 250 has a first bearing structure 252 disposed therein between the first stationary bearing housing and rotary shell 210. A second stationary bearing housing 260 has a second bearing structure 262 disposed therein between the second stationary bearing housing and cover extension 242.

A first port 270 is defined in first stationary bearing housing 250 for communication between a source of pressurized fluid (not shown) and cavity 220 on the left side of piston 222 on FIG. 2, while a second port 272 is defined in second bearing housing 260 for communication between the source of pressurized fluid and the cavity on the right side of the piston on FIG. 2. Circular seals 280, 282, 284, 286, 288, 290, 292, and 294 are provided as shown to seal between the various components of cylinder 200.

In use, introduction of pressurized fluid through first port 270 into cavity 220 on the left side of piston 222 drives tooling 232 to the right on FIG. 2. Introduction of pressurized fluid through second port 272 into cavity 220 on the right side of piston 222 and the release of any pressure on the left side of the piston causes tooling 232 to be driven to the left on FIG. 2. Concomitantly with or during or before and/or after such linear motion of tooling 232, the tooling may be made to rotate by means of rotation of adapter plate 212, in a manner similar to the description above with respect to cylinder 10 (FIG. 1).

Thus, cylinder 10 (FIG. 1) is single-acting, while cylinder 200 (FIG. 2) is double-acting.

Figure 3:
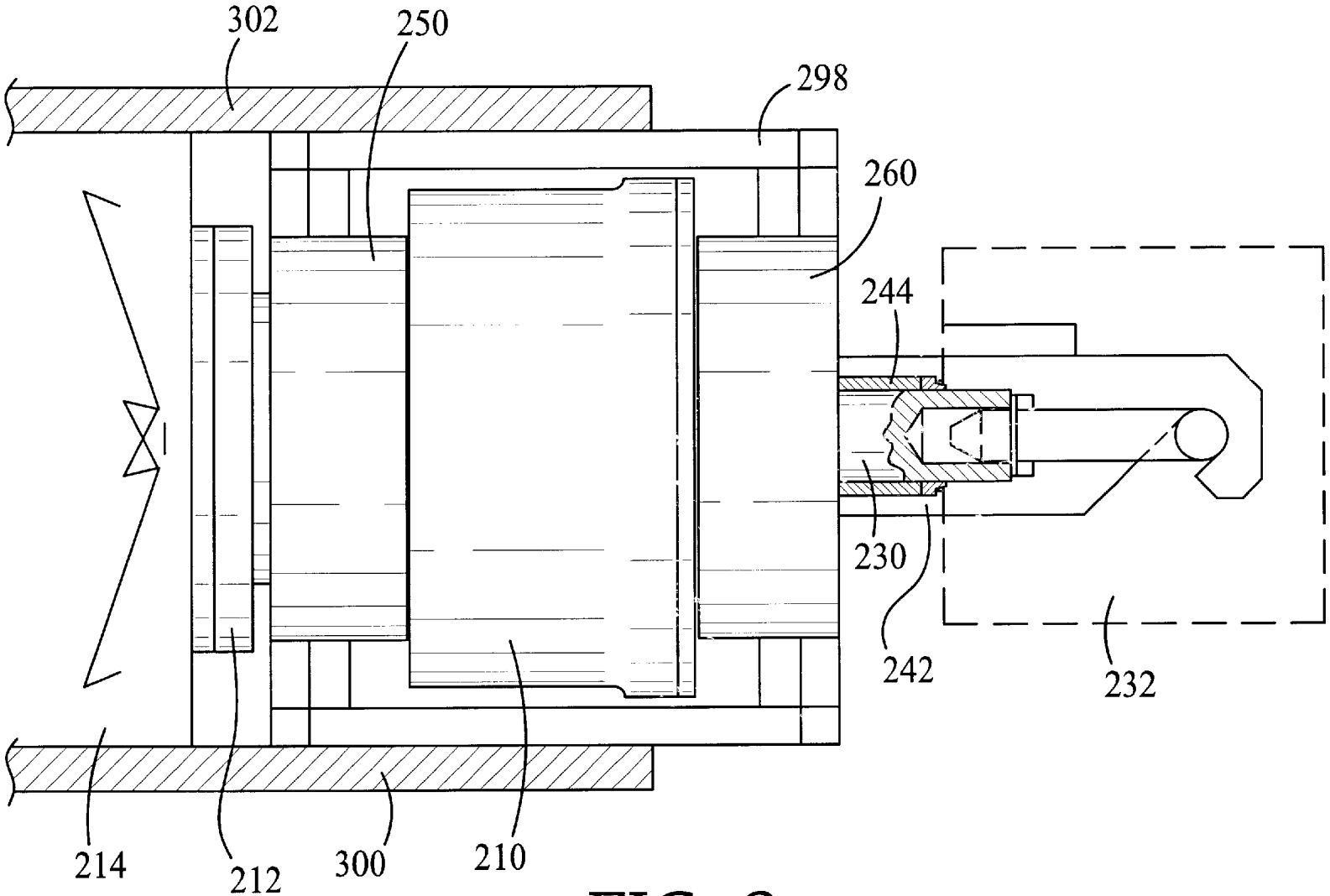
FIG. 3 is a side elevational view of the embodiment of FIG. 2 disposed in a housing.

FIG. 3 illustrates cylinder 200 (FIG. 2) with a frame 298 fixedly attached to first and second bearing housings 250 and 262, the frame being, in turn fixedly attached to housing 214 by means of first and second straps 300 and 302. Attachment may be by any suitable means.

Cylinder 10 (FIG. 1) and cylinder 200 (FIG. 2) can be economically manufactured from any suitable materials using conventional manufacturing methods.

Terms such as "upper", "lower","inner", "outer", "inwardly", "outwardly", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

The embodiments of the invention in which an exclusive property or privilege is claimed are defined as follows:

1. A fluid-operated cylinder to provide both linear and rotary motion to tooling, comprising:

(a) a cylindrical, rotatable member for attachment to rotatable means;

(b) a circular piston disposed in said cylindrical, rotatable member for back and forth axial motion in a cavity defined therein and rotatable by rotation of said cylindrical, rotatable member;

(c) a first port defined through said cylindrical rotatable member to introduce pressurized fluid into said cavity on a first side of said circular piston such as to cause said circular piston to move in a first direction; and (d) a piston shaft fixedly attached to said circular piston and fixedly attachable to said tooling;

whereby: when said rotatable member is rotated, rotary motion will be transmitted to said tooling by said piston shaft, and when said pressurized fluid is introduced into said cavity on said first side of said circular piston, said piston shaft will cause said tooling to move in said first direction.

2. A fluid-operated cylinder, as defined in claim 1, further comprising: a compression spring disposed in said cavity against a second side of said circular piston such as to urge said piston in a second direction opposite to said first direction.

3. A fluid-operated cylinder, as defined in claim 1, further comprising: a second port defined through said cylindrical, rotatable member to introduce pressurized fluid into said cavity such as to cause said piston to move in a second direction opposite to said first direction.

* * * * *